US006307814B1

(12) United States Patent
Farine et al.

(10) Patent No.: US 6,307,814 B1
(45) Date of Patent: Oct. 23, 2001

(54) DEVICE INCLUDING AT LEAST TWO COAXIAL WHEELS AND MEANS FOR DETECTING THE ANGULAR POSITION THEREOF AND METHOD FOR DETECTING SAID ANGULAR POSITIONS

(75) Inventors: Pierre-André Farine, Neuchâtel; Jean-Jacques Born, Morges; Ermanno Bernasconi, Neuchâtel, all of (CH)

(73) Assignee: Asulab S.A., Bienne (CH)

( * ) Notice: Subject to any disclaimer, the term of this patent is extended or adjusted under 35 U.S.C. 154(b) by 0 days.

(21) Appl. No.: 09/336,715

(22) Filed: Jun. 21, 1999

(30) Foreign Application Priority Data

Jun. 29, 1998 (CH) ..... 1382/98

(51) Int. Cl.[7] ..... G04B 19/04; G04C 9/00

(52) U.S. Cl. ..... 368/80; 368/73; 368/187; 368/250

(58) Field of Search ..... 368/10, 47, 72–74, 368/76, 80, 181, 185–187, 272, 273, 250

(56) References Cited

U.S. PATENT DOCUMENTS

| | | | | |
|---|---|---|---|---|
| 3,815,351 | * | 6/1974 | Vovelle | 368/250 |
| 4,084,403 | * | 4/1978 | Kitai et al. | 368/80 |
| 4,196,579 | * | 4/1980 | Schaefer | 368/181 |
| 4,238,781 | | 12/1980 | Vercellotti et al. | 340/870.37 |
| 4,420,263 | * | 12/1983 | Besson et al. | 368/80 |
| 4,645,357 | * | 2/1987 | Allgaier et al. | 368/187 |
| 5,202,858 | * | 4/1993 | Kanzaki | 368/80 |
| 5,222,053 | * | 6/1993 | Ohhira | 368/80 |
| 5,245,591 | * | 9/1993 | Katou | 368/80 |
| 5,270,993 | * | 12/1993 | Besson et al. | 368/80 |
| 5,465,239 | * | 11/1995 | Koch | 368/80 |
| 5,898,644 | * | 4/1999 | Ganter et al. | 368/47 |
| 6,038,523 | * | 3/2000 | Akahane et al. | 368/74 |

FOREIGN PATENT DOCUMENTS

| | | |
|---|---|---|
| 38 28 810 A | 3/1990 | (DE) . |
| 195 24 030 C | 11/1996 | (DE) . |
| WO97/45705 | 12/1997 | (WO) . |

* cited by examiner

*Primary Examiner*—Diego Gutierrez
*Assistant Examiner*—Jeanne-Marguerite Goodwin
(74) *Attorney, Agent, or Firm*—Griffin & Szipl, P.C.

(57) ABSTRACT

A device of small dimensions includes a two coaxial wheels (4, 6) respectively including two plates (44, 46) parallel to each other. A sensor (10) including a detection element (14).formed by a magnetic or capacitive element, in particular a flat spiral coil, is provided for detecting the angular position of both of the two wheels. In order to do this, the sensor (10) detects the presence or absence of an active material above the detection element (14). For this purpose, each of plates (44) and (46) has at least one inactive region for the sensor and is formed at least partially of active material for the sensor. The sensor is arranged relative to the wheel the closest to the detection element in such a way that the latter is at least in part above or below said at least one inactive region in at least one determined angular position of said wheel so as to allow the sensor to detect the angular position of the wheel whose plate (44) is furthest from the detection element (14). The inactive regions of the plates are preferably formed by openings.

15 Claims, 6 Drawing Sheets

DEVICE INCLUDING AT LEAST TWO COAXIAL WHEELS AND MEANS FOR DETECTING THE ANGULAR POSITION THEREOF AND METHOD FOR DETECTING SAID ANGULAR POSITIONS

FIELD OF THE INVENTION

The present invention concerns on the one hand a device of small dimensions including at least two coaxial wheels, rotatably mounted about a same geometrical axis of rotation and means for detecting the angular positions of the reference geometrical semi-axes associated with said wheels. On the other hand, the present invention concerns a method for detecting the angular positions of several coaxial wheels which can be applied to the device according to the invention.

BACKGROUND OF THE INVENTION

Those skilled in the art know optical devices for detecting the reference angular positions of wheels, in particular coaxial wheels belonging to the gear train of a clockwork movement. All these optical detection devices are relatively complex. They require a light source and a light receiver at a distance from said source. The mounting of an optical detection device is often difficult given the precise adjustment necessary between the light source, the receiver and the wheels associated with such device. In the case of the present invention, one thus proposes omitting any optical wheel position detection system for a device of small dimensions.

International Patent Application No. 97/45705 discloses a system for detecting the position of coaxial wheels respectively associated with coaxial hands of a clockwork movement. On each of the coaxial wheels, formed of full plates, are arranged several discrete portions of a hard magnetic film defining an identification pattern for a contactless inductive sensor. An inductive sensor is associated with each of the coaxial wheels. In other words, there are as many magnetic inductive sensors as coaxial wheels whose angular positions have to be detected, in particular given reference positions. The amplitude of the signal detected by the inductive sensors varies according to whether or not they are situated in front of a segment of magnetic material, as is shown in particular in FIGS. 3 and 4 of the International Patent Application.

The detection system proposed in Patent Document No. WO 97/45705 is disadvantageous in that each wheel associated with an inductive sensor must be fitted with the segment or distinct portion of a solid magnetic film arranged on one face of the plate of the wheel. The manufacturing cost of the wheels is thus increased and the wheel plates are full or solid, which can be a drawback for the working of the clockwork movement, in particular from the point of view of power consumption. The wheel plates are formed of at least two different materials, namely the material forming the plate itself and the magnetic material arranged on one surface of this plate. In addition to these drawbacks, a major drawback relating to the cost of the detection system proposed and to the space requirement thereof will be mentioned, namely that there are as many inductive sensors as wheels whose position has to be detected. Thus, for three coaxial wheels, there are three inductive sensors respectively associated with said three wheels.

SUMMARY OF THE INVENTION

An object of the present invention is to overcome the aforementioned drawbacks by providing a device of small dimensions including coaxial wheels and efficient means for detecting the angular position of at least two coaxial wheels which are relatively simple, inexpensive, compact and easily able to be integrated into the device.

The present invention therefore concerns a device of small dimensions, in particular of the horological type, including a first wheel and a second wheel which are coaxial, rotatably mounted about a same geometrical axis of rotation and respectively including a first plate and a second plate perpendicular to said geometrical axis of rotation, this device further including means for detecting the angular positions of a first reference geometrical semi-axis of said first wheel, and a second reference geometrical semi-axis of said second wheel, this device being characterised in that said means for detecting the angular positions of said first and second semiaxes are formed by a single inductive or capacitive sensor provided with an element for detecting the presence of active materials above or below it, said first plate including at least one inactive region for said sensor, said first and second plates being formed at least partially of active materials for said sensor, said sensor being arranged relative to said first wheel so that its detection element is at least in part above or below said first inactive region in at least one determined angular position of said first wheel.

As a result of the features of the device according to the invention, the respective angular positions of at least two coaxial wheels are determined using a single inductive or capacitive sensor, in particular using an inductive sensor whose electronic circuit is disclosed in European Patent No. 0 746 100, which is integrated by reference in the present description.

The use of an inductive proximity sensor is particularly well suited to the case of the present invention, such a sensor being able to detect the presence of various materials, in particular non ferromagnetic metals like aluminium or brass which are widely used for the manufacture of wheels and other clockwork movement parts.

According to a preferred embodiment, said first inactive region of the plate of the first wheel is defined by a first opening provided in such plate. More generally, all the inactive regions of the plates of the coaxial wheels associated with the sensor are defined by openings. Consequently, the plates of the coaxial wheels can be formed of a single same active material for the selected sensor, the openings provided in these plates corresponding to inactive regions for the sensor.

Another object of the invention is to provide a method for detecting the angular positions of N coaxial wheels able to be applied to the device according to the invention in an efficient and reliable manner, i.e. assuring a level of accuracy in the detection of said angular positions.

The present invention therefore concerns a method for detecting the angular positions of N coaxial wheels, N being greater than 1, by means of a single inductive or capacitive sensor, these N wheels including respectively N plates each having at least one inactive region for said sensor which includes an element for detecting active materials forming at least partially each of said N plates, this detection element and each of said inactive regions being arranged so that they are superposed one above the other in at least one determined angular position of the wheel having said inactive region, said N plates each defining a reference geometrical semi-axis which can be detected by said sensor, said method comprising the following successive steps wherein the N plates are numbered in an ascending order from the plate situated closest to said detection element to the plate the furthest from said detection element:

A) Determining the angular position of said semi-axis of wheel No. 1;

B) Bringing or leaving said inactive region of wheel No. 1 into superposition with said detection element, or waiting until this inactive region and detection element are superposed with each other;

C) Performing steps A) and B) successively for wheel Nos. 2 to (N−1), if required;

D) Determining the angular position of said semi-axis of wheel N.

As a result of the features of this method, it is possible to detect, using a single inductive or capacitive sensor, at least one reference angular position of each of the coaxial wheels of a device, in particular of a clockwork movement.

BRIEF DESCRIPTION OF THE DRAWINGS

The present invention will be described in more detail hereinafter, with reference to the anneal drawings which are given by way of non-limiting example, and in which.

DESCRIPTION OF PREFERRED EMBODIMENTS

Figure 1:
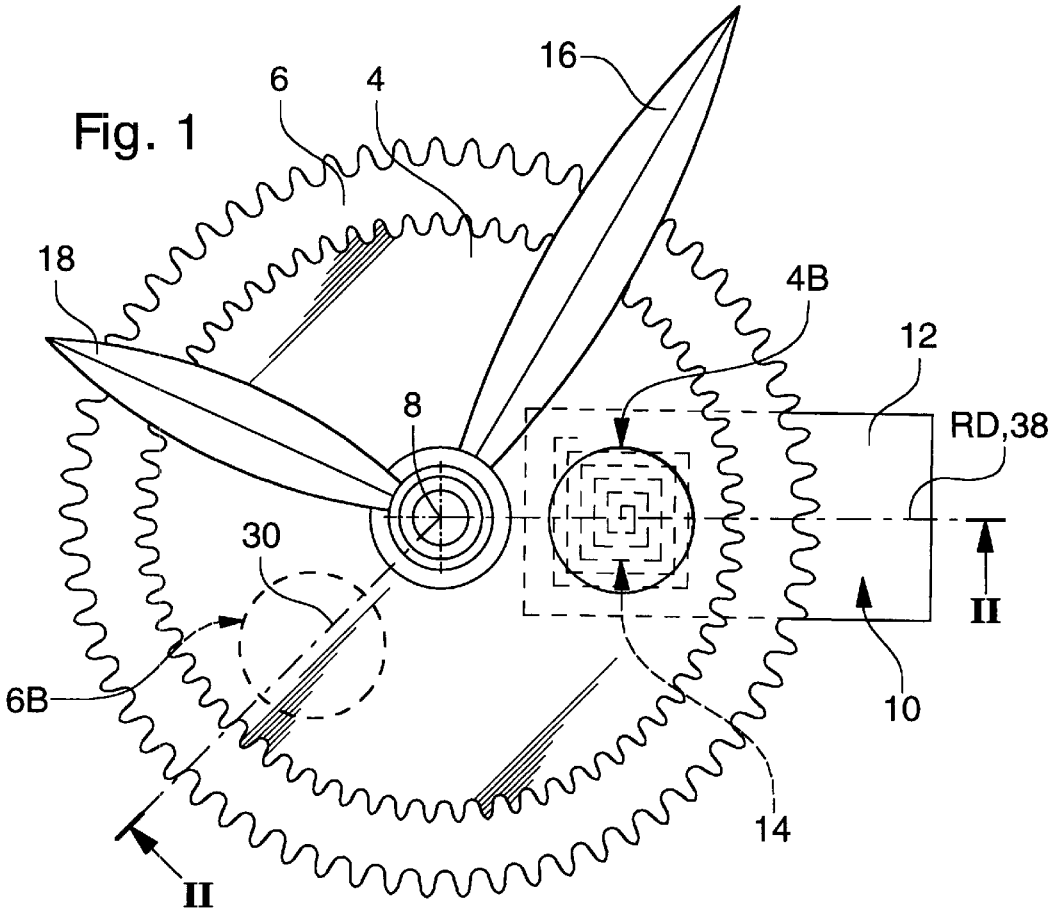
FIG. 1 is a schematic plane view of two coaxial wheels associated with an inductive sensor.
Figure 2:
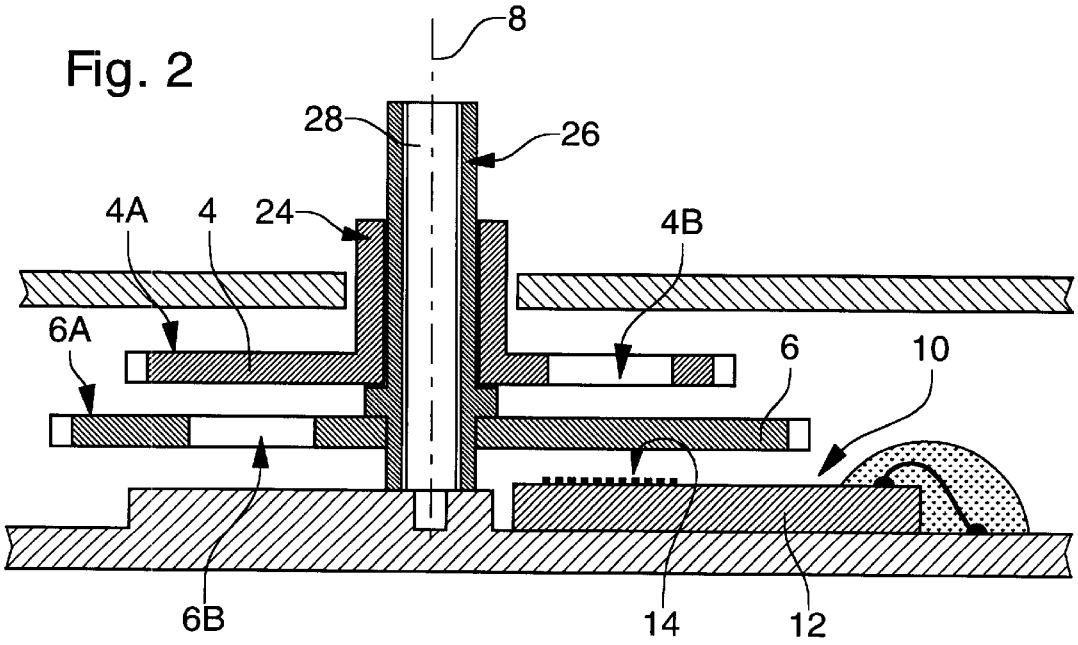
FIG. 2 is a cross-section along the line II—II of FIG. 1, the hands not having been shorn while other elements of the device of FIG. 1 are shown.
Figure 3:
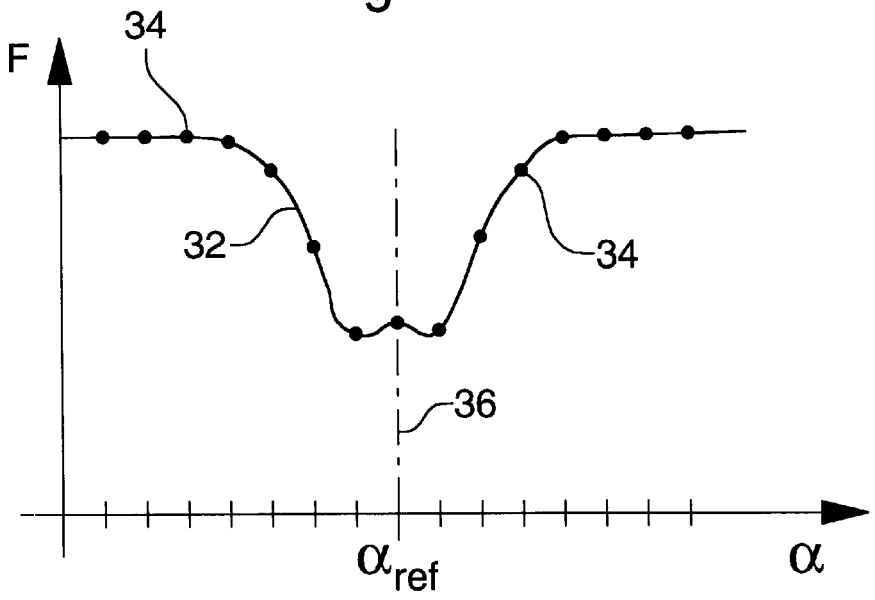
FIG. 3 shows schematically a measurement curve of the type able to be obtained using measuring signals provided by the device of FIGS. 1 and 2, this curve allowing the reference angular position of one or other of the two coaxial wheels to be determined.

With reference to FIGS. 1 to 3, a first embodiment of a device according to the invention and a mode for detecting the angular position of the two coaxial wheels associated therewith will be described hereinafter.

The device includes two coaxial wheels 4 and 6, rotatably mounted about a same geometrical axis of rotation 8. These two wheels have respectively two plates 4A and 6A which are parallel to each other and perpendicular to geometrical axis 8. In order to determine the respective angular positions of two reference semi-axes associated respectively with the two plates 4A and 6A, there is provided an inductive sensor 10 including a support 12 on one face of which is arranged an element for detecting the presence of the material forming plates 4 and 6 above said detection element. This detection element is formed by a flat spiral coil 14. Two openings 4B and 6B provided respectively in plates 4 and 6 are associated with sensor 10. It will be noted that in an embodiment which is not shown, the coil can be formed by a self-supporting winding.

Wheels 4 and 6 are respectively associated with two hands 16 and 18 of an analogue display. The cylindrical shaft 24 and 26 of wheels 4 and 6 are rotatably mounted about a central shaft 28.

Plates 4A and 6A are formed of materials which are active for sensor 10, i.e. materials whose presence in proximity to detection element 14 is detected by inductive sensor 10. Openings 4B and 6B define first and second inactive regions of plates 4A and 6A. In the preferred case in which these inactive regions are formed by openings, the absence of material in superposition with coil 14 generates a different measuring signal to that provided in the presence of active materials forming plates 4A and 6A in superposition with said coil 14.

The detection of reference semi-axis 30 of wheel 6 whose plate 6A is closest to detection element 14 will be described first. In order to do this reference will be made to FIG. 3 which corresponds to FIG. 3 of European Patent No. 98110729.5 whose content is incorporated in the present description by reference.

FIG. 3 shows schematically a curve 32 obtained by a succession of measurement points 34 provided by inductive sensor 10 during the passage of opening 6B above coil 14. The inductive sensor provided in this embodiment includes a similar electronic circuit to that described in European Patent No. 0 746 100, this sensor defining a differential relaxation oscillator. The measuring signal provided by such a sensor is representative of a frequency determined by the electronic circuit of this sensor, this frequency varying as a function of the variation in presence of the active material forming plate 6A above coil 14. When this coil 14 is facing the active material forming plate 6A, the frequency has a high value. Conversely, when coil 14 is situated substantially facing opening 6B, the frequency is low. Curve 32 defines schematically the evolution in the value of the frequency generated in the sensor as a function of the angular position of reference semi-axis 30 of wheel 6 which starts from geometrical axis 8 and passes through the geometrical centre of circular opening 6B.

It will be noted that curve 32 is substantially symmetrical relative to axis 36 corresponding to the value $\alpha=\alpha_{ref}$. Thus, using an appropriate analysis of the evolution of measurement points 34 as a function of the angular position a of semi-axis 30 passing above or below coil 14, it is possible to determine which measurement corresponds to the angular position $\alpha=\alpha_{ref}$ of semi-axis 30, i.e. when the latter is substantially identical or superposed with a reference semi-axis RD of sensor 10 which starts from geometrical axis 8 and crosses the magnetic axis of coil 14, which is parallel to axis 8 and passes substantially through the geometrical centre of coil 14.

It will be noted that the width of the dip of graph 32 (or the peak in an alternative embodiment of the electronic circuit of sensor 10) is a function of the profile of opening 6B and in particular of the angular dimension of this opening. Once opening 68 has passed above coil 14, thanks to driving means provided and known to those skilled in the art, the measurement of the angular position corresponding to $\alpha_{ref}$ can be determined by electronic means which are also known to those skilled in the art. One will cited for example the calculation of the middle point of the width of the dip of curve 32 at a characteristic depth.

Once the angular position of semi-axis 30 has been determined, according to the invention, opening 6B is brought or left in superposition with coil 14, or one waits until opening 6B is superposed with coil 14 to detect the angular position of reference semi-axis 38 associated with wheel 4, this latter semi-axis 38 starting from geometrical axis 8 and passing through the geometrical centre of opening 4B provided in plate 4A. Preferably, opening 6B has sufficiently large dimensions that spiral coil 14 is mostly above or below opening 6B, defining an inactive region of plate 6A, in at least one determined angular position of wheel 6, namely in the present case when semi-axes 30 and RD are substantially identical to or superposed with each other.

Thus, according to the invention, in order to detect the angular position of reference semi-axis 38 of the plate 4A further from coil 14 than plate 6A, the closest opening 6B to coil 14 is either brought substantially to face said coil, or one waits until it faces said coil. Then, opening 4B is either brought above coil 14 or one waits until it passes above said coil and, consequently, also above opening 6B to detect the angular position of semi-axis 38. In order to do this, a series of measurements similar to those represented in FIG. 3 are effected and the analysis of the resulting curve similar to curve 34 enables the detection means to determine which measurement corresponds to the angular position $\alpha=\alpha_{ref}$ for semi-axis 38. This series of measurements and the analysis of the resulting curve and made possible by the fact that plate 6 has an inactive region above coil 14 during detection of the passing of opening 4B above (or below) coil 14 of sensor 10 which responds to a variation in the presence of the active materials constituting plates 4A and 6A above or below its detection element by a variation in an oscillation frequency belonging to sensor 10 on which the measurement signal provided by said sensor depends.

It will be noted that, for the second opening 4B belonging to the plate 4 furthest from detection element 14, the dip in the measurement curve similar to curve 32 can be defined by a single measurement point, in particular by decreasing the angular dimension of opening 4B, this opening being able to have in particular the shape of a radial slit. It is possible to determine a lower threshold value for frequency F below which a measurement point indicates that the geometrical axis of the slit is substantially aligned with reference axis RD of sensor 10. In such a case, the angular position of wheel 4 is directly determined by a single measurement value corresponding to the angular position $\alpha_{ref}$ for semi-axis 38, which is then the same as or superposed with reference semi-axis RD. It will be noted that such a particular case simplifies processing of the measurement results for the detection of the angular position of wheel 4.

It will be noted however that opening 6B machined in plate 6A can have considerably smaller dimensions than those of coil 14 without thereby preventing sensor 10 from detecting the angular position of the reference semi-axis associated with wheel 4, and thus without departing from the scope of the present invention. However, in such a case, the efficiency of the measurement is decreased, i.e. there is liable to be less contrast in the frequency variation. Theoretically, the minimum condition for the present invention is given by the necessity for the two openings 4B and 6B and spiral coil 14 to be superposed with each other in at least one situation, i.e. in at least a first determined angular position of wheel 6 and at least a second determined angular position of wheel 4. Conversely, in order to assure greater measurement efficiency for sensor 10, and given the distance between plate 4 and coil 14, it is preferable for opening 6B to have dimensions at least comparable to those of coil 14 so that at least most of said coil is situated facing opening 6B in said at least first determined angular position of wheel 6.

Figure 4:
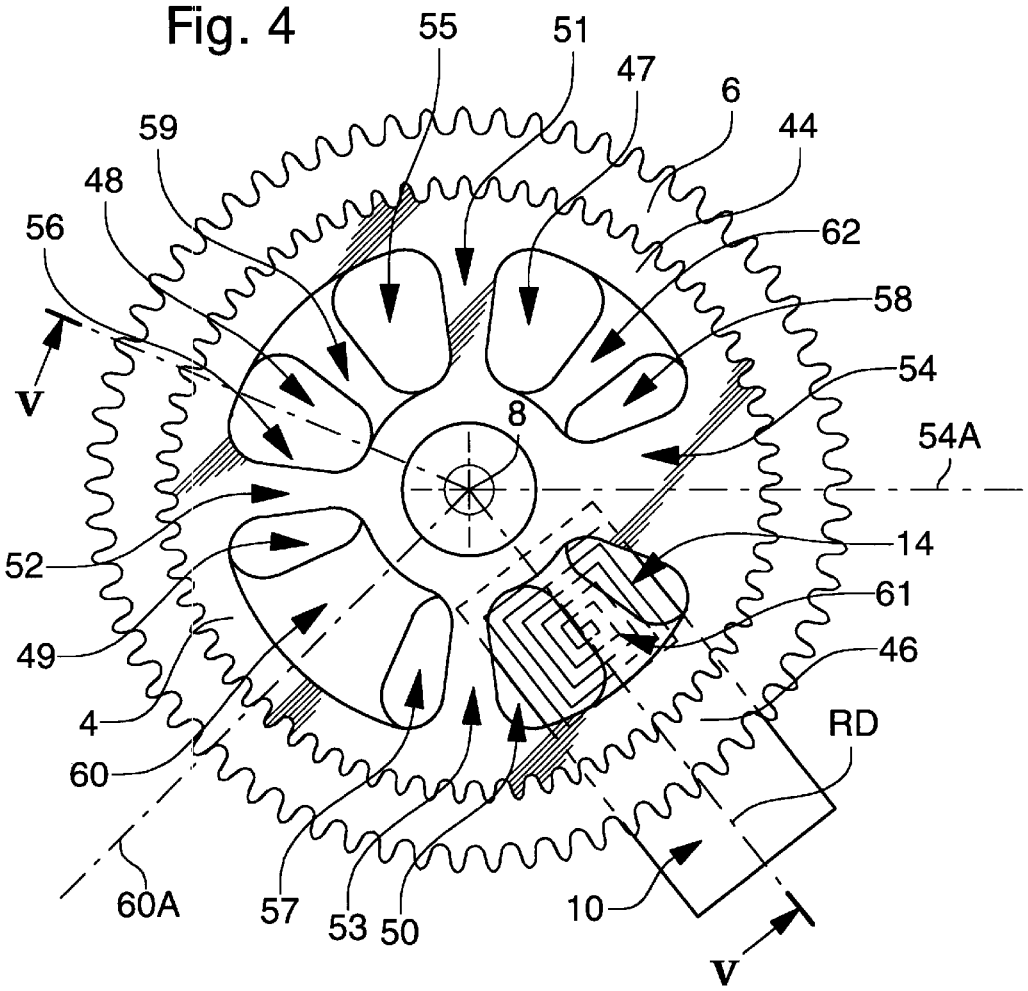
FIG. 4 shows schematically in plane a second embodiment according to the invention.
Figure 5:
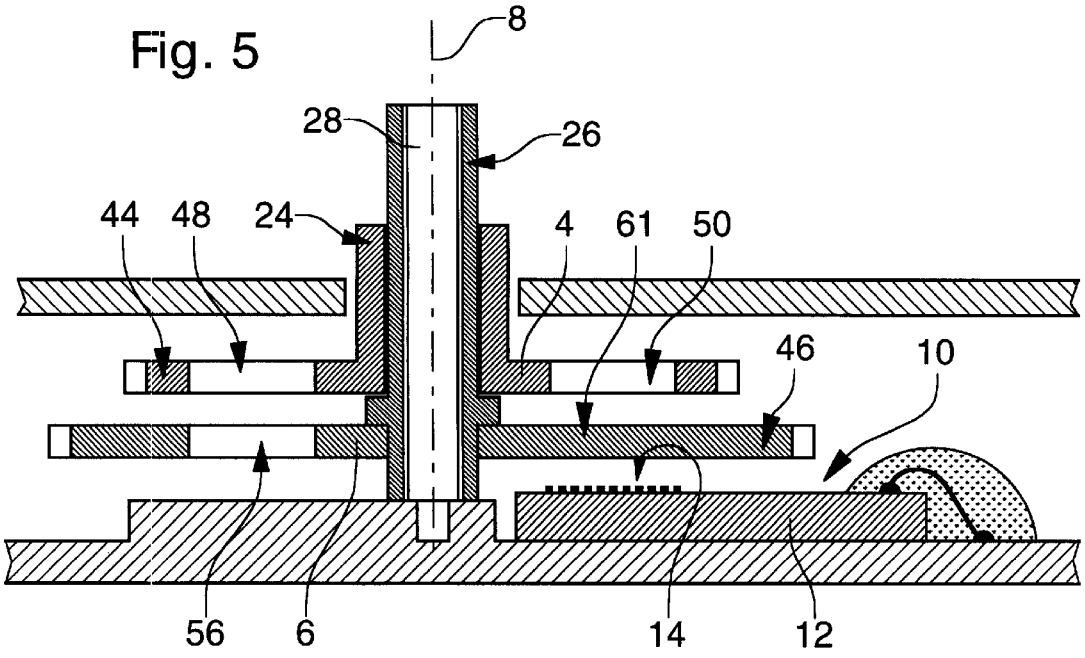
FIG. 5 is a similar cross-section to FIG. 2 along the line V—V of FIG. 4.

FIGS. 4 and 5 show a second embodiment of a device according to the invention. This device includes a sensor 10 whose detection element is formed by a spiral coil 14 in the same way as the first embodiment described hereinbefore. The references which have already been described will not be described again here in detail. This second embodiment differs from the first essentially in the arrangement of plates 44 and 46 of coaxial wheels 4 and 6. Plate 44 has four openings 47 to 50 which define four arms 51 to 54, arm 54 having a greater width/angular dimension than that of arms 51 to 53 which are substantially the same as each other. Plate 46 also has four openings 55 to 58 arranged at a same distance from geometrical axis 8 as the corresponding openings 47 to 50 of plate 44. Openings 55 to 58 also define four radial arms 59 to 62, arm 60 having a greater width/angular dimension than that of arms 59, 61 and 62 which are substantially identical. The median line of radial arm 54 defines a reference semi-axis 54A of plate 44, while the median line of radial arm 60 defines a reference semi-axis 60A of plate 46.

Figure 6:
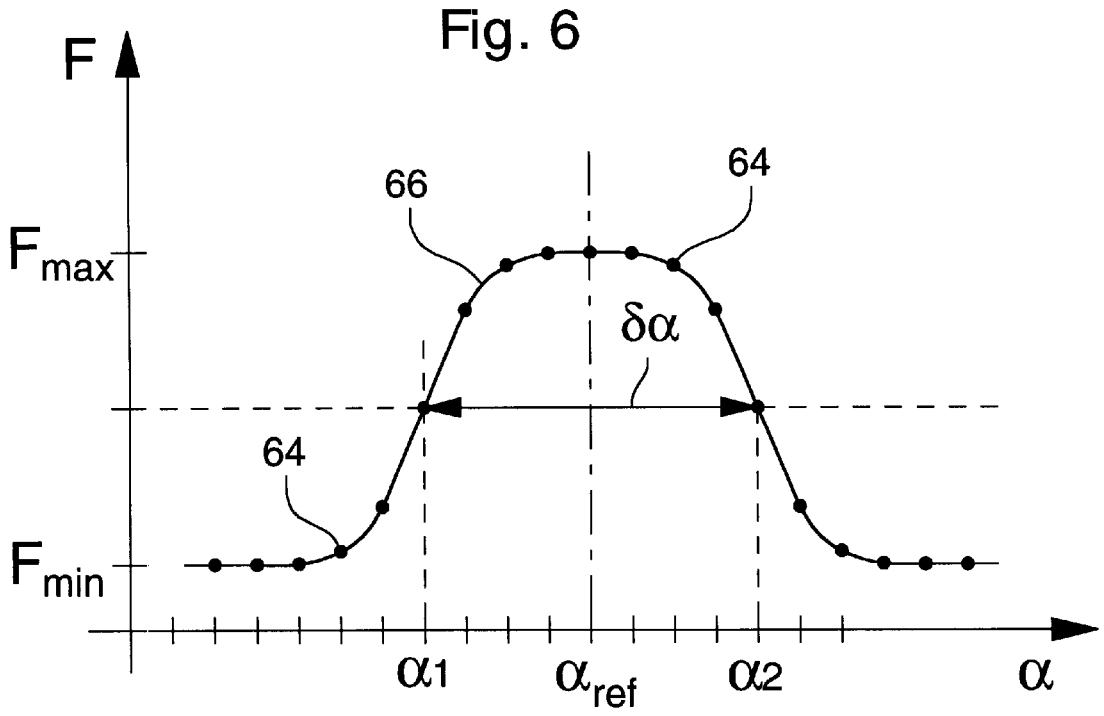
FIG. 6 shows schematically a curve obtained using measuring signals provided by the sensor of the device of FIGS. 4 and 5, allowing the reference angular position of one or other of the two coaxial wheels of such device to be determined.

In this second embodiment, the passage of arm 60 and 54 respectively is detected in order to detect the angular position of wheel 6 and 4 respectively. In order to do this, the passage of arm 60 and 54 respectively above spiral coil 14 of inductive sensor 10 is detected. Again, the angular position of the plate 46 which is closest to coil 14 is first detected. With reference to FIG. 6, several successive measurements 64 are effected during rotation of plate 46 until arm 60 passes above coil 14. The successive measurements 64 define a substantially symmetrical curve 66. When one of openings 47 to 50 is situated facing coil 14, the internal frequency of the oscillator forming sensor 10 corresponds substantially to $F_{min}$. Conversely, when arm 60 is situated facing coil 14, the frequency increases to a value $F_{max}$.

Given the symmetry of arm 60 and the resulting symmetry of curve 66, two characteristic parameters can be deduced by an electronic circuit of sensor 10, namely the angular position corresponding to the middle of the peak generated by the passing of arm 60 in front of coil 14 and the angular width $\delta\alpha$ half way up the peak, $\delta\alpha=\alpha2-\alpha1$. Measurement of $\delta\alpha$ allows arm 60 to be differentiated from the three other arms 59, 61 and 62 which each have a lower angular dimension. Detection of arm 60 could possibly be determined by the value of Fmax which will probably be greater during the passing of arm 60 relative to the passing of the three other arms of plate 46.

Determination of $\alpha_{ref}$ allows one to determine when semi-axis 60A is aligned with reference semi-axis RD of sensor 10, i.e. when the two semi-axes 60A and RD are the same or superposed with each other. Thus, while memorizing the time evolution of the rotation of plate 46, the electronic circuit for detecting the angular positions of wheels 4 and 6 can determine the instantaneous angular position of plate 46 once the moment or the measurement corresponding to the angular position $\alpha_{ref}$ of semi-axis 60A has been determined.

Once the angular position of wheel 6 has been determined, plate 46 is driven in rotation or left so that coil 14 is superposed at least mostly with one of openings 55 to 58 of plate 46. In another mode for detecting the position of wheel 4, one waits until coil 14 is situated facing one of openings 55 to 58 to proceed with the detection of the angular position of wheel 4. Since an opening defines an inactive region for sensor 10, the latter then detects the passing of the arms of the plate 44 which is furthest from coil 14. Detection of the passing of radial arm 54 and determination of the angular position of reference semi-axis 54A corresponding to $\alpha_{ref}$ is effected in a similar way to that explained in detail hereinbefore for wheel 6 with reference to FIG. 6.

Figure 11:
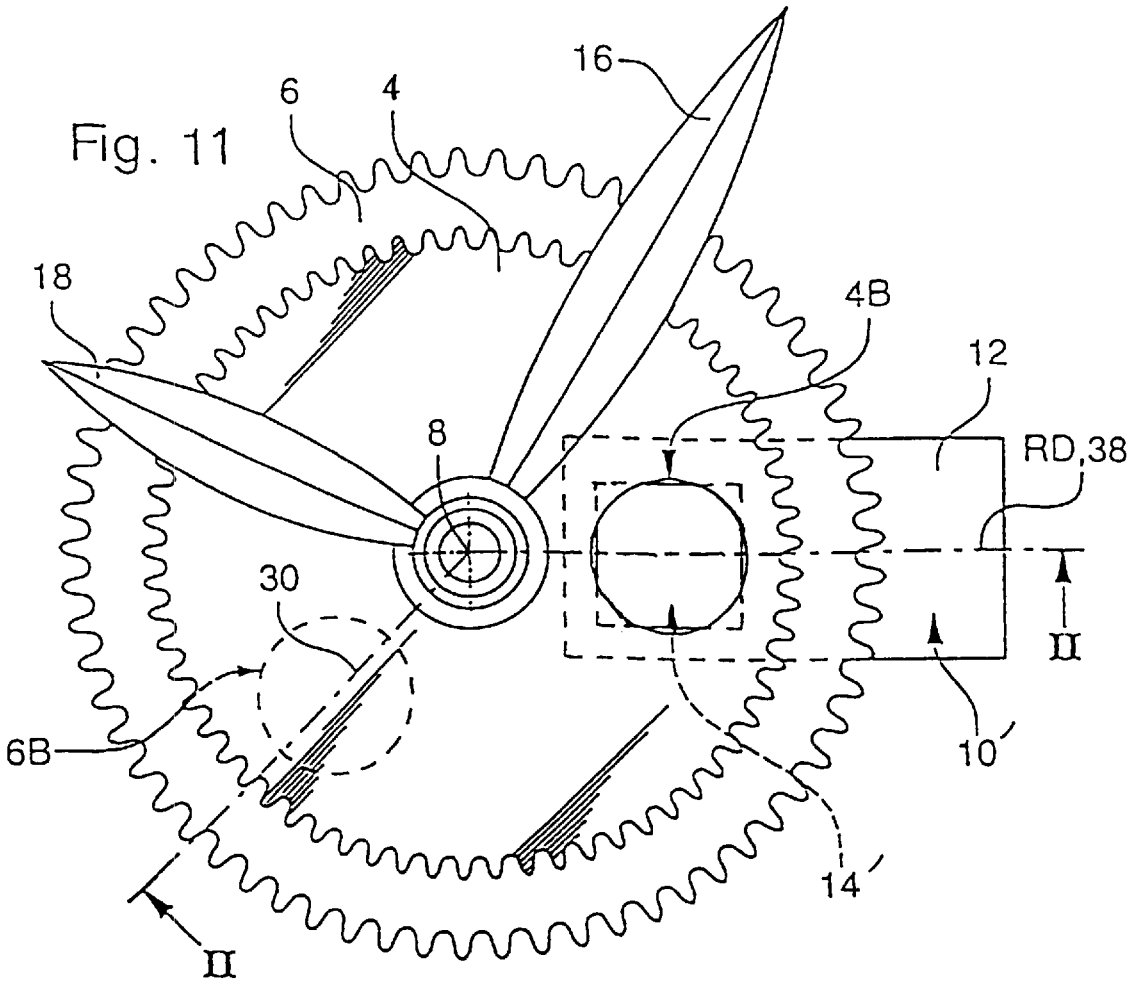

Thus, detection of the angular positions of the two coaxial wheels 4 and 6 is effected using a single sensor 10 which, according to the invention, is inductive or capacitive. FIG. 11 illustrates a capacitive sensor 10', the detection element comprising an electrode 14' situated at the surface of the substrate 12. The wheels 4 and 6 and in particular the plates of these wheels are arranged so that there is a variation in capacitance as a function of the presence of an opening or a full or solid portion facing the detection element.

In order to guarantee accurate detection of the angular positions of wheels 4 and 6, an improvement to the invention proposes effecting a check consisting in bringing or leaving wheel 4 in a position in which coil 14 is superposed at least mostly with one of openings 47 to 50 of plate 44, then driving plate 46 in rotation so that radial arm 60 passes above coil 14 again effecting a series of measurements allowing the passing of semi-axis 60A onto the semi-axis RD corresponding to angular position $\alpha_{ref}$ to be determined entirely reliably. This measurement may be more accurate than the first effected given that, during the first measurement, the exact angular position of wheel 4 was not known and that it is possible that one of arms 51 to 54 of plate 44 was situated substantially facing coil 14; which can create a certain asymmetry in the curve which is shown in FIG. 6 and obtained on the basis of successive measurements.

Once the angular position of wheel 6 has been checked, the result of this second detection is kept for the angular position of wheel 6. Finally, according to an alternative of the detection method according to the invention, it is possible to check again the angular position of wheel 4 having the furthest plate 44 from coil 14. Given that the angular position of wheel 6 is now known precisely, it is possible to assure that detection of the angular position of wheel 4 is effected when the plate of wheel 6 is angularly positioned so that coil 14 is at least mostly superposed with an opening of plate 46. It will be noted that such a check proves particularly well advised when checking of the angular position of wheel 6 has shown a difference between the initial detection and the check detection for wheel 6.

Figure 7:
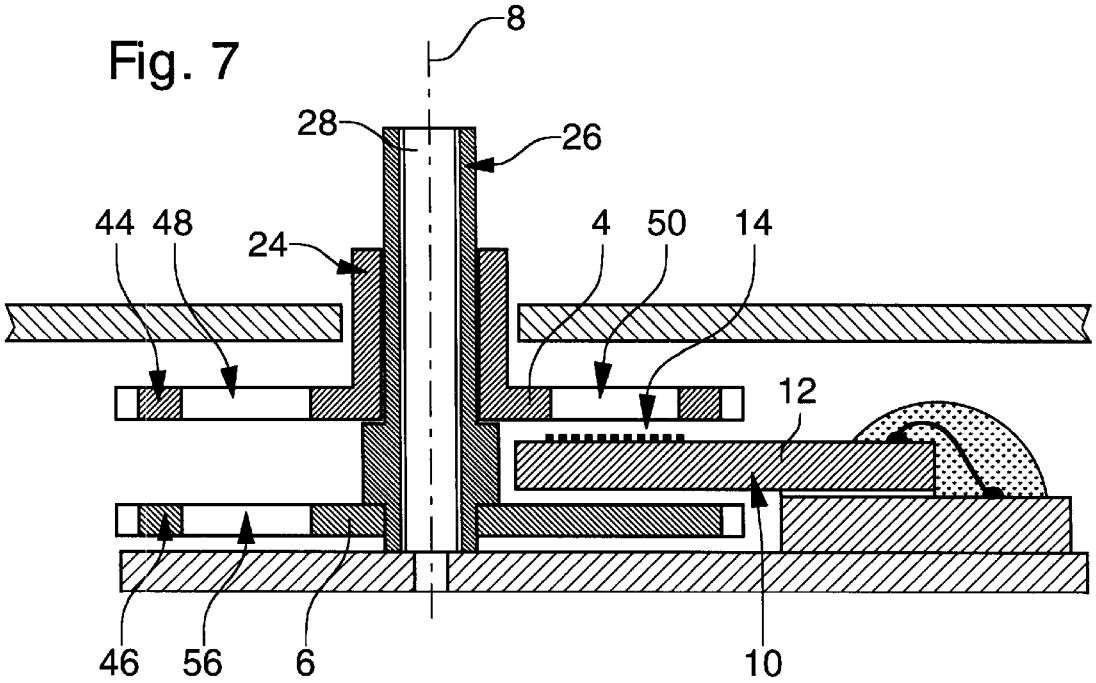
FIG. 7 is similar cross-section to that of FIG. 5, of a third embodiment of the device according to the invention.

FIG. 7 shows a third embodiment of the invention. Plates 44 and 46 of coaxial wheels 4 and 6 are identical to those shown in FIGS. 4 and 5 described hereinbefore. This third embodiment differs from the second embodiment in that substrate 12 of sensor 10 which has coil 14 on its upper face is arranged between plates 44 and 46. In this case, plate 44 is the closest to coil 14. It will be noted however that substrate 12 can be turned over in an alternative embodiment so that coil 14 is situated under substrate 12 facing plate 46. The method for detecting the angular position of the two wheels 4 and 6 is similar to that described hereinbefore. The arrangement of this third embodiment can be advantageous given that plates 44 and 46 are situated on either side of flat coil 14.

Figure 8:
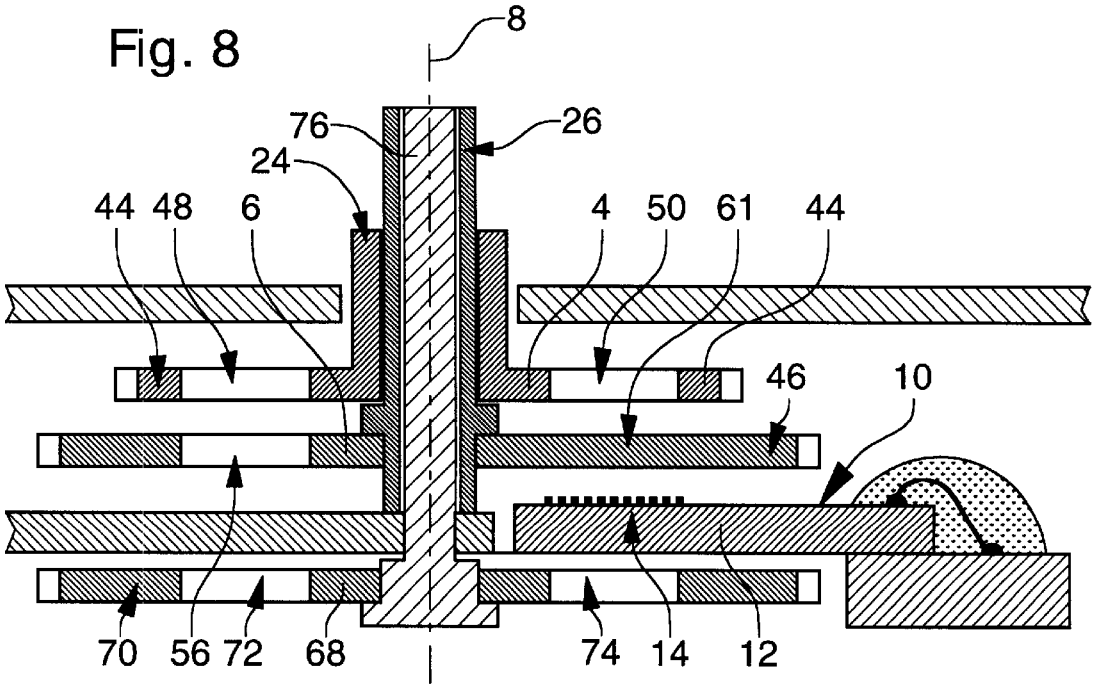
FIG. 8 is a similar cross-section to FIG. 5, of a fourth embodiment of the device according to the invention.

FIG. 8 shows a fourth embodiment of the device according to the invention. This device includes three coaxial wheels 4, 6 and 68 associated with a single same sensor 10 used for the detection of the angular positions of these three coaxial wheels. Wheels 4 and 6 are similar to wheels 4 and 6 of the second embodiment described hereinbefore with reference to FIGS. 4 and 5, these two wheels being situated in an identical manner relative to sensor 10. The third wheel 68 includes a plate 70 parallel to plates 44 and 46. This plate 70 has the same openings as plates 44 and 46. Thus, plate 70 also defines four radial arms with one of these arms having a greater width/angular dimension than the others. The openings in plate 70, two of which 72 and 74 are shown in the cross-section of FIG. 8, are arranged radially in an identical way to the openings of plates 44 and 46.

In the event that the wheels have different diameters and have openings having different radial dimensions from one plate to another, one need only assure that at least one opening of each plate and detection element 14 are superposed one with the others in at least one determined position of the corresponding wheel.

Detection of the angular positions of wheels 4 and 6 is performed in a similar way to that described within the scope of the second embodiment. The same is true for wheel 68 the arrangement of which relative to sensor 10 is similar to that of wheel 6 of the third embodiment described with reference to FIG. 7. It will be noted however that plate 46 is the closest to coil 14, while plate 44 is the furthest from said coil 14.

Thus, according to the method for detecting the position of the three coaxial wheels according to the invention, the angular position of wheel 6 is first detected as previously described, then plate 46 is brought or left in an angular position in which coil 14 is mostly superposed with an opening of plate 46. Then, the angular position of wheel 68 whose plate 70 is situated below coil 14, at a smaller distance than that of plate 44, is determined. Once the reference semi-axis of plate 70 has been detected and thus the angular position of wheel 68 has been determined, plate 70 is brought or left in an angular position in which coil 14 is superposed with an opening in plate 70, in particular with opening 74. Finally, the angular position of wheel 4 is detected by sensor 10, plate 46 being still in an angular position in which coil 14 is superposed with an opening of plate 46. Preferably, the opening of plate 70 situated facing coil 14 during detection of the angular position of wheel 4 also has sufficient dimensions for most of coil 14 to be superposed with this opening in at least one determined angular position of wheel 68. Plate 70 of wheel 68 is formed of an active material for sensor 10, like plates 44 and 46.

A check can be made of the angular positions of the three coaxial wheels starting with the closest plate to coil 14 up to the furthest plate, in the same way as the case with two wheels described hereinbefore. In order to do this, the other plates are brought or left in angular positions in which coil 14 is above or below an opening of each of the other plates, or one waits until the device is in such a situation.

Figure 9:
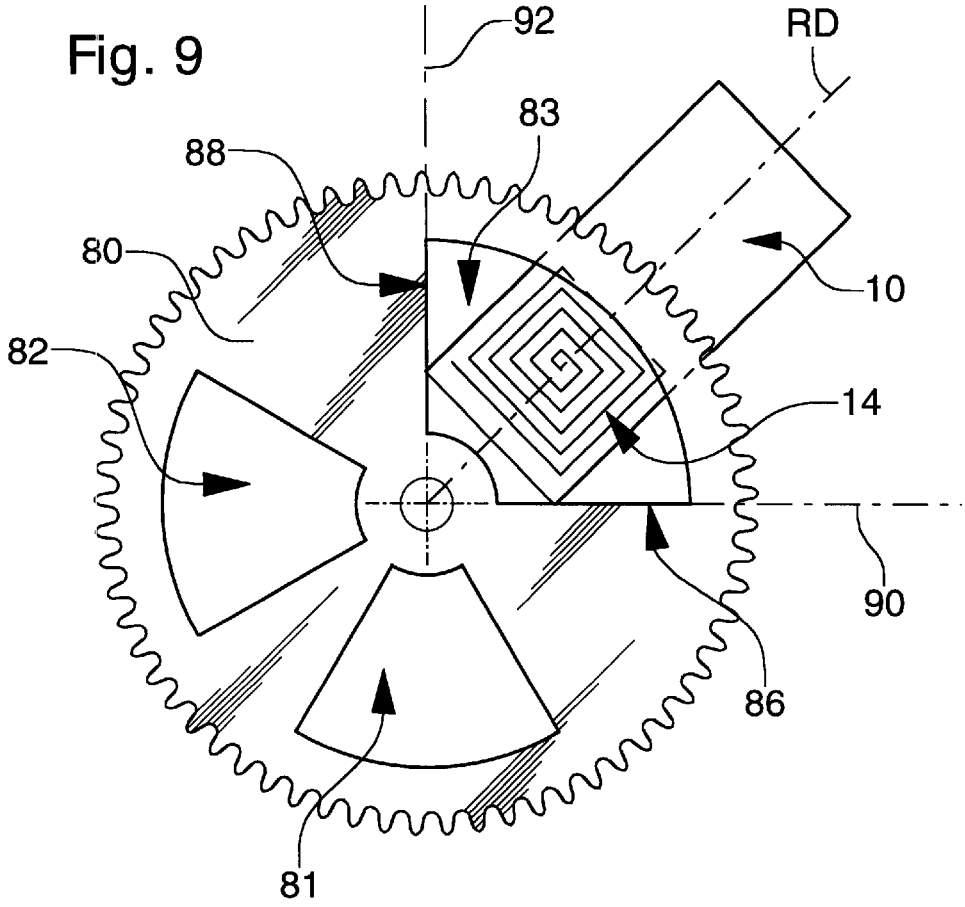
FIG. 9 shows schematically an alternative embodiment of the coaxial wheels shown in the preceding Figures.
Figure 10:
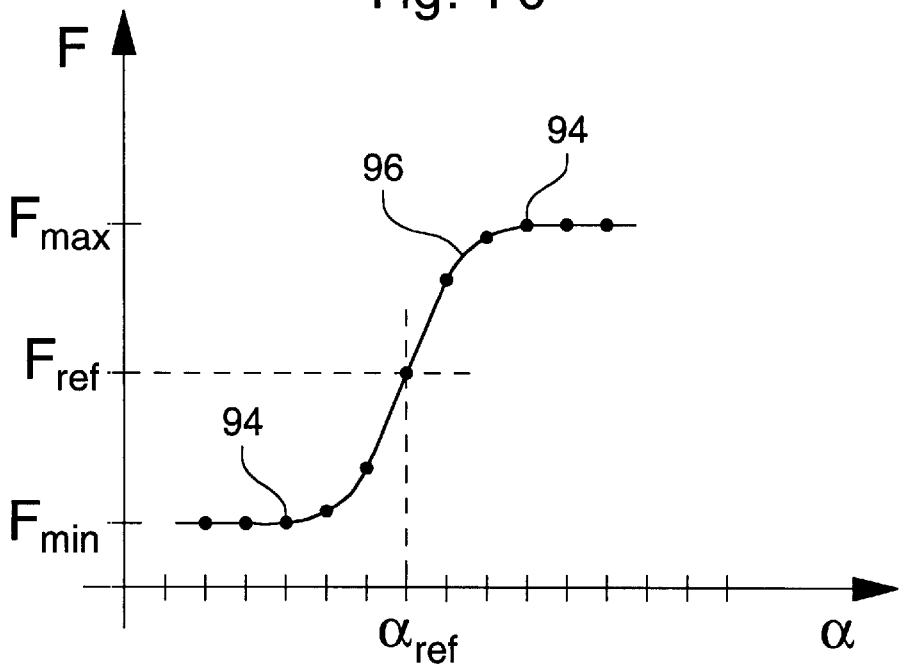
FIG. 10 shows schematically a curve obtained using measuring signals during a transition between a full or portion and an opening of the wheel shown in FIG. 9; and, FIG. 11 shows two coaxial wheels associated with a capacitive sensor.

FIG. 9 shows a variant of the plate of wheel 4, 6 and 68 respectively. This plate 80 has three openings 81, 82 and 83 forming annular sectors separated by three material parts also defining three angular sectors. Thus, the radial edges of openings 81 to 83 and the intermediate material portions define radial segments of plate 80. By way of example, the two radial segments 86 and 88 respectively define two reference semi-axes 90 and 92 of plate 80. Each of the these two reference semi-axes can be detected by the detection means using successive measurements 94 defining an S shaped curve 96 shown in FIG. 10.

During passing from a full or solid portion to opening 83 or from this opening 83 to a full or solid portion of plate 80 above flat coil 14, the frequency of the oscillator of sensor 10 passes from $F_{min}$ to $F_{max}$ or vice versa according to the arrangement of the electronic circuit defining the oscillator of sensor 10. The alignment of reference semi-axis 90 and 92 respectively with reference semi-axis RD of sensor 10, corresponding to reference angle $\alpha_{ref}$, corresponds to the middle point of S shaped curve 96. $\alpha_{ref}$ corresponds to a resonance frequency $F_{ref}$.

Thus, when the frequency of the oscillator corresponds to $F_{ref}$, the alignment of a radial edge of an opening 81 to 83 with semi-axis RD is detected. In the case of plate 80, it is also necessary to determine the angular widths between two transitions. Given that only opening 83 defines an angle of 90°, and providing that the direction of rotation of plate 80 is known, it is possible to determine univocally the angular position of semi-axis 90 and 92 respectively. Moreover, given that the three radial arms separating the openings do not all have an identical angular width, semi-axis 90 and 92 respectively can be univocally detected without also requiring the other semi-axis to be detected.

It will also be noted that plate 80 defines a plurality of reference semi-axes at least six of which can be reliably and efficiently exploited.

What is claimed is:

1. A horological device of small dimensions, including a first wheel and a second wheel which are coaxial, rotatably mounted about a same geometrical axis of rotation and respectively including a first plate and a second plate perpendicular to said geometrical axis of rotation, this device further including means for detecting the angular positions of a first reference geometrical semi-axis of said first wheel, and a second reference geometrical semi-axis of said second wheel, wherein said means for detecting the angular positions of said first and second semi-axes are formed by a single inductive sensor provided with an element for detecting the presence of at least one active material above or below said element, said first plate including at least one first inactive region for said sensor, said first and second plates being formed at least partially of said at least one active material for said sensor, said sensor being arranged relative to said first wheel so that its detection element is at least in part above or below said first inactive region in at least one determined angular position of said first wheel.

2. A device according to claim 1, wherein said sensor responds to a variation in the presence of an active material above or below said detection element by a variation in at least one parameter or in a variable of said sensor on which a measurement signal provided thereby depends, said first inactive region having dimensions provided so that said detection element is at least mostly facing said first inactive region in said determined angular position.

3. A device according to claim 1, wherein said first inactive region is defined by a first opening provided in said first plate.

4. A device according to claim 3, wherein said first and second plates are formed by active materials for said sensor, the second plate having at least one second opening, said detection element being arranged so that it is at least partially above or below said second opening in at least one determined angular position of said second wheel.

5. A device according to claim 4, wherein said first and said second semi-axis is defined by a radius starting from said geometrical axis of rotation and either passing substantially through the geometrical center of said first and said second opening, respectively, or defined by a radial edge of said first and said second opening, respectively, or identical to a median line of a portion made of said at least one active material of said first and said second plate extending radially between two inactive regions of said first and said second plate, respectively.

6. A device according to claim 1, wherein said sensor includes a support at the surface of which is arranged said detection element, said support being arranged facing said first plate, said second plate being situated on the other side of said first plate relative to said support, said sensor being arranged to detect the presence above said detection element of the active material at least partially forming said second plate when said first wheel is in said determined angular position.

7. A device according to claim 1, wherein said sensor includes a support at the surface of which is arranged said detection element, said support being arranged between said first and second plates, said detection element being situated facing said first plate.

8. A device according to claim 7, further including a third wheel which is coaxial to said first and second wheels and including a third plate perpendicular to said geometrical axis of rotation, said third wheel defining a third reference geometrical semi-axis whose angular position can be detected by said inductive sensor, said third plate being situated on the other side of said first plate relative to said support of said sensor and being at least partially formed of said at least one active material , said sensor being arranged to detect the presence above or below said detection element of said at least one active material at least partially forming said third plate when said first wheel is in said determined angular position.

9. A device according to claim 8, wherein said second plate includes at least one second inactive region for said sensor, arranged so that said detection element is at least mostly above or below said second inactive region in at least one determined angular position of said second wheel.

10. A device according to claim 8, wherein said third plate is formed by an active material and has a third opening, said detection element being arranged so that it is at least partially above or below said third opening in at least one determined angular position of said third wheel, said third semi-axis being defined by a radius starting from said geometrical axis of rotation and either passing substantially through the geometrical centre of said third opening, or defined by a radial edge of said third opening, or identical to a median line of a part made of active material of said third plate extending radially between two inactive regions of said third plate.

11. A method for detecting the angular positions of N coaxial wheels, N being greater than 1, by means of a single inductive sensor, said N wheels respectively including N plates each having at least one inactive region for said sensor which includes a detection element of at least one active material at least partially forming each of said N plates, said detection element and each of said inactive regions being arranged so that they are superposed with each other in at least one determined angular position of the wheel having said inactive region, said N plates each defining a reference geometrical semi-axis which can be detected by said sensor, said method comprising in the following successive steps wherein the N plates are numbered in an ascending order from the plate situated closest to said detection element to the plate the furthest from said detection element:

A) determining the angular position of said semi-axis of wheel No. 1;

B) bringing into or leaving said inactive regions of wheel No. 1 in superposition with said detection element, or waiting until this inactive region and detection element are superposed with each other;

C) performing steps A) and B) successively for wheel Nos. 2 to (N−1), if required;

D) determining the angular position of said semi-axis of wheel N.

12. A method according to claim 11, further including the following successive steps of:

E) Bringing into or leaving inactive region No. 2 in the event that N=2, respectively the inactive regions of wheels Nos. 2 to N in the event that N is greater than 2 in superposition with said detection element, or waiting until said inactive region, respectively said inactive regions and said detection element are superposed with each other;

F) Checking the angular position of said semi-axis of wheel No. 1, and keeping the angular position resulting from this check in the event that it does not correspond to the angular position measured during step A;

G) Performing in ascending order for each wheel No. 2 to (N−1), if required, a check of the angular position of the semi-axis associated with said wheel after having brought into or left the inactive regions of the other wheels in superposition with said detection element, or having waited for said inactive regions and said detection element to be superposed with each other, and keeping the angular position resulting from this check for each wheel No. 2 to (N−1) in the event that it does not correspond to the angular position measured during step C).

13. A method according to claim 12, further including a final step of:

H) Checking the angular position of the semi-axis associated with wheel No. N after having brought into or left said inactive region in the event that N=2, respectively the inactive regions Nos. 1 to (N−1) in the event that N is greater than 2, in superposition with said detection element, or having waited for said inactive region, respectively said inactive regions and said detection element to be superposed with each other, this step being performed preferably if the step(s) for checking the angular position(s), of wheel 1, respectively wheels 1 to (N−1), have shown at least one erroneous detection during steps A) to C).

14. A horological device of small dimensions, including a first wheel and a second wheel which are coaxial, rotatably mounted about a same geometrical axis of rotation and respectively including a first plate and a second plate perpendicular to said geometrical axis of rotation, this device further including means for detecting the angular positions of a first reference geometrical semi-axis of said first wheel, and a second reference geometrical semi-axis of said second wheel, wherein said means for detecting the angular positions of said first and second semi-axes are formed by a single capacitive sensor provided with an element for detecting the presence of at least one active material above or below said element, said first plate including at least one inactive region for said sensor, said first and second plates being formed at least partially of at least one active material for said sensor, said sensor being arranged relative to said first wheel so that its detection element is at least in part above or below said first inactive region in at least one determined angular position of said first wheel.

15. A method for detecting the angular positions of N coaxial wheels, N being greater than 1, by means of a single capacitive sensor, said N wheels respectively including N plates each having at least one inactive region for said sensor which includes a detection element of at least one active material at least partially forming each of said N plates, said detection element and each of said inactive regions being arranged so that they are superposed with each other in at least one determined angular position of the wheel having said inactive region, said N plates each defining a reference geometrical semi-axis which can be detected by said sensor, said method comprising in the following successive steps wherein the N plates are numbered in an ascending order from the plate situated closest to said detection element to the plate the furthest from said detection element:

A) determining the angular position of said semi-axis of wheel No. 1;

B) bringing into or leaving said inactive regions of wheel No. 1 in superposition with said detection element, or waiting until this inactive region and detection element are superposed with each other;

C) performing steps A) and B) successively for wheel Nos. 2 to (N−1), if required;

D) determining the angular position of said semi-axis of wheel N.

* * * * *